US008827597B2

(12) United States Patent
Bach et al.

(10) Patent No.: US 8,827,597 B2
(45) Date of Patent: Sep. 9, 2014

(54) LOAD TRANSFER OR CONNECTOR DEVICE FOR EXPANDED CELL CONFINEMENT STRUCTURES AND METHODS FOR DOING THE SAME

(71) Applicant: Reynolds Presto Products Inc., Richmond, VA (US)

(72) Inventors: Gary Michael Bach, Appleton, WI (US); William Gregory Handlos, Manitowoc, WI (US); Jeremy Anthony McConnell, Brillion, WI (US); Cory Scott Schneider, Green Bay, WI (US); Bryan Scott Wedin, Green Bay, WI (US); Patricia J. Stelter, Appleton, WI (US)

(73) Assignee: Reynolds Presto Products Inc., Richmond, VA (US)

( * ) Notice: Subject to any disclaimer, the term of this patent is extended or adjusted under 35 U.S.C. 154(b) by 0 days.

(21) Appl. No.: 13/746,531

(22) Filed: Jan. 22, 2013

(65) Prior Publication Data

US 2014/0205790 A1 Jul. 24, 2014

(51) Int. Cl.
*E02D 17/20* (2006.01)
*A44B 11/04* (2006.01)

(52) U.S. Cl.
CPC ..... *E02D 17/20* (2013.01); *A44B 11/04* (2013.01)
USPC ..... 405/302.4; 405/302.6; 24/458; 403/408.1

(58) Field of Classification Search
USPC ..... 405/258.1, 302.4, 302.6, 302.7; 24/200, 24/458; 403/408.1
See application file for complete search history.

(56) References Cited

U.S. PATENT DOCUMENTS

| | | | | |
|---|---|---|---|---|
| 1,455,636 | A | 5/1923 | McConnal | |
| 4,778,309 | A | 10/1988 | Bach et al. | |
| 4,965,097 | A | 10/1990 | Bach | |
| 5,449,543 | A | 9/1995 | Bach et al. | |
| 5,758,987 | A * | 6/1998 | Frame et al. | 403/408.1 |
| 5,927,906 | A | 7/1999 | Bach et al. | |
| 6,395,372 | B1 | 5/2002 | Bach | |
| 6,484,473 | B1 | 11/2002 | Hall | |
| 7,544,010 | B2 | 6/2009 | Restrepo et al. | |
| 8,092,122 | B2 | 1/2012 | Senf et al. | |
| 8,459,903 | B2 * | 6/2013 | Senf et al. | 405/302.4 |
| 2008/0213521 | A1 | 9/2008 | Halahmi et al. | |
| 2011/0217117 | A1 | 9/2011 | Halahmi et al. | |

OTHER PUBLICATIONS

US 5,336,544, 08/1994, Bach et al. (withdrawn)

* cited by examiner

*Primary Examiner* — Frederick L Lagman
(74) *Attorney, Agent, or Firm* — Merchant & Gould P.C.

(57) ABSTRACT

A device that includes an insertion member, a shank, and a body having a through-hole and a post. The device can be part of a cellular confinement system. A method of transferring load from an expanded cellular confinement structure to a flexible tendon includes inserting an insertion member of a device through an open slot in the structure, inserting a tendon through a through-hole in the body of the device, and wrapping the tendon around a post of the body. A kit includes a first unitary section of cells, at least one device, and at least one tendon for securing the device and the section to allow transfer of load from the web to the tendon.

44 Claims, 18 Drawing Sheets

LOAD TRANSFER OR CONNECTOR DEVICE FOR EXPANDED CELL CONFINEMENT STRUCTURES AND METHODS FOR DOING THE SAME

TECHNICAL FIELD

This disclosure relates to load transfer or connection devices for expanded cellular confinement structures for the confinement of infill material. In particular, this disclosure relates to devices used to transfer load exerted by expanded and filled cellular confinement structures to tendons which in turn are anchored by stakes or other methods. This disclosure relates to methods used for fastening the device to the cellular confinement structures, and for fastening the device to the supporting tendon and for connecting at least two expanded sections.

BACKGROUND

A cellular confinement structure serves to increase the load bearing capacity, stability, and erosion resistance of infill materials which are placed within the cells of the system and can serve to protect underlying soils or as a protective layer over pond liners or other protective membranes. A commercially available system is Geoweb® plastic web confinement structure sold by Reynolds Presto Products Inc., Appleton, Wis. Geoweb® cells are made from high density polyethylene strips that are joined by welds on their faces in a side-by-side relationship at alternating spaces so that when the strips are stretched out in a direction perpendicular to the faces of the strips, the resulting section is honeycomb-like in appearance, with sinusoidal or undulated-shaped cells. Geoweb® sections are lightweight and are shipped in their collapsed form for ease in handling and installation. Geoweb® systems have been described in U.S. Pat. Nos. 8,092,122; 6,395,372; 5,927,906; 5,449,543; 4,778,309; and 4,965,097, each of these patents being incorporated by reference herein.

A challenge for channels and slopes includes the limitations of length of cellular confinement sections used upon slopes due to the cumulative forces of the weight of the infill contained by the cellular confinement section upon the welds that define the shape of expanded cell. Either stakes, or tendons, or both needs to be used to transfer the forces from the filled cell to the ground, and this transfer of force needs to occur in sufficient locations to allow for the forces never to exceed the capacity of the welds. Another challenge associated with the use of cellular confinement systems is that the fill material and the cellular confinement sections may be displaced during installation and long-term operation. Erosion below the cellular confinement section may cause infill to drop out of the cells. Applied forces such as hydraulic uplift or ice action may lift the cellular confinement section or lift the fill material out of the cells. Translational movement of the cellular confinement section may also occur in channel lining applications, or when installing on steep slopes.

In one improvement, a load transfer device was developed and sold by Reynolds Presto Products under the tradename Atra® Clip. This load transfer device is described in U.S. Pat. No. 5,927,906, incorporated herein by reference, and depicted in FIGS. 21 and 22. Continuing improvements in these types of systems and connections are desirable.

SUMMARY OF THE DISCLOSURE

A device for use with at least one expanded cellular confinement structure is provided. In general, the device includes an insertion member having first and second opposite insertion ends. An integral shank extends from the insertion member and is spaced from each of the first and second insertion ends. An integral body extends from the shank at an end of the shank remote from the insertion member and includes a face opposing the insertion member; a post with a tendon-receiving holding surface; and a through-hole sized to receive a tendon.

In another aspect, a cellular confinement system is provided. The cellular confinement system includes at least a first unitary section of cells made from elongated plastic strips bonded together in spaced apart areas. The strips form walls of the cells and at least some of the cells define open slots. At least one device is oriented in a first one of the slots. The device can be the type as characterized above. When used, the insertion member is located on the first side of the cell wall within a first one of slots. The body is located on a second side of the cell wall. At least one flexible tendon extends through the first one of the slots, and through the through-hole in the body, and is wrapped around the post of the body.

In another aspect, a method of transferring load from an expanded cellular confinement structure for retaining material to a flexible tendon is provided. The method includes providing an expanded cellular confinement structure having a plurality of cells formed by cell walls, the cell walls having first and second opposite sides and at least one open slot. The method includes inserting an insertion member of a device from the second side of the cell wall through the open slot to provide the insertion member on the first side of the cell wall; a body of the device on the second side of the cell wall; and a shank between the insertion member and the body extending through the slot. The method further includes inserting a tendon through a through-hole in the body and wrapping the tendon around a post of the body.

In another aspect, a kit is provided. The kit includes at least one device, at least one unitary section of cells, and at least one tendon. The device includes an insertion member having first and second opposite insertion ends. An integral shank extends from the insertion member and is spaced from each of the first and second insertion ends. An integral body extends from the shank at an end of the shank remote from the insertion member and includes a face opposing the insertion member; a post with a tendon-receiving holding surface; and a through-hole sized to receive the tendon.

DETAILED DESCRIPTION

Example Systems of Use

Figure 1:
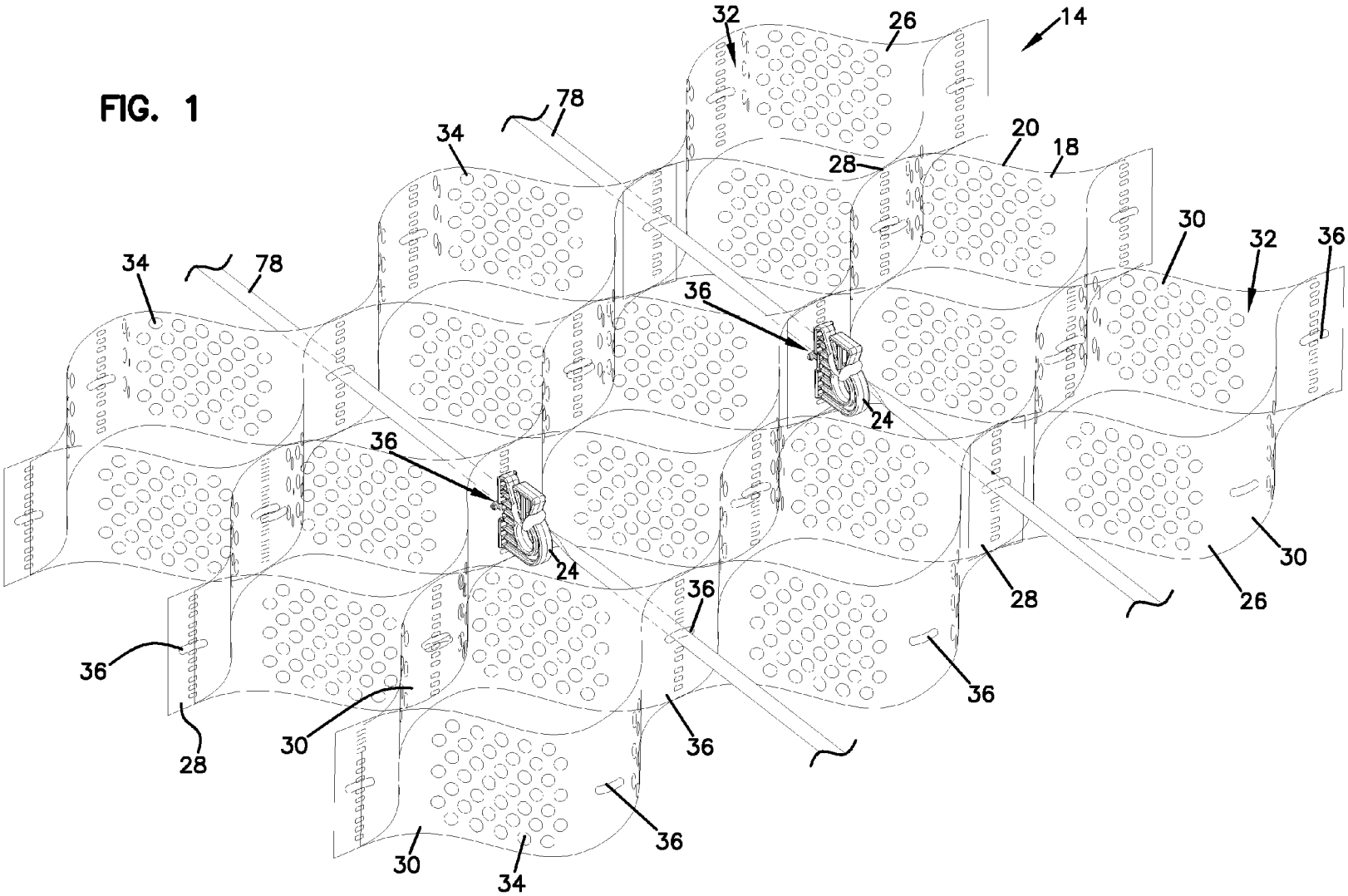
FIG. 1 is a schematic view of a cellular confinement system having devices to transfer load exerted by a cellular confinement structures to tendons, constructed in accordance with principles of this disclosure.
Figure 2:
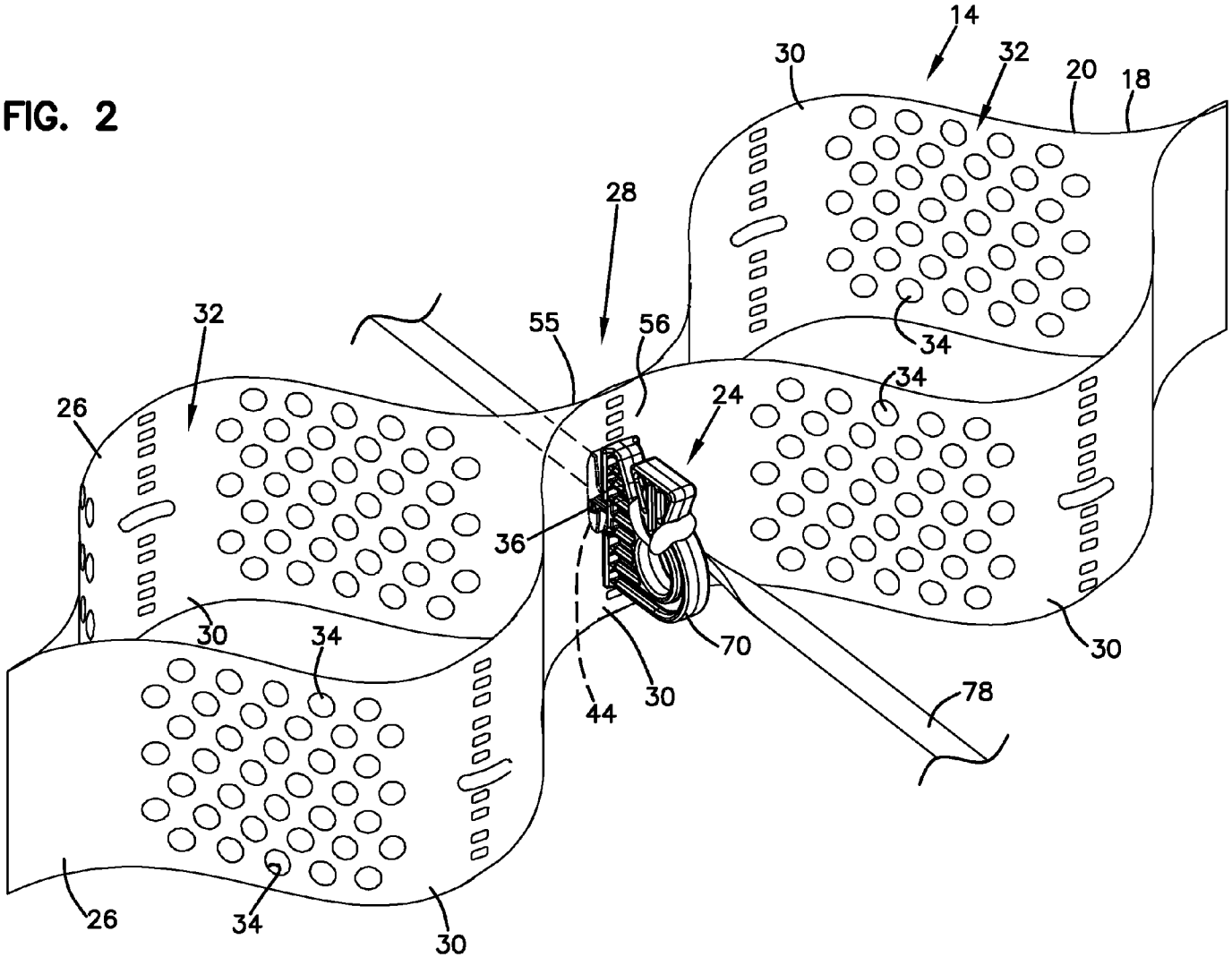
FIG. 2 in an enlarged view of a portion of the system of FIG. 1, depicting one device affixed to a cellular confinement structure and a tendon, utilizing principles in accordance with this disclosure.
Figure 3:
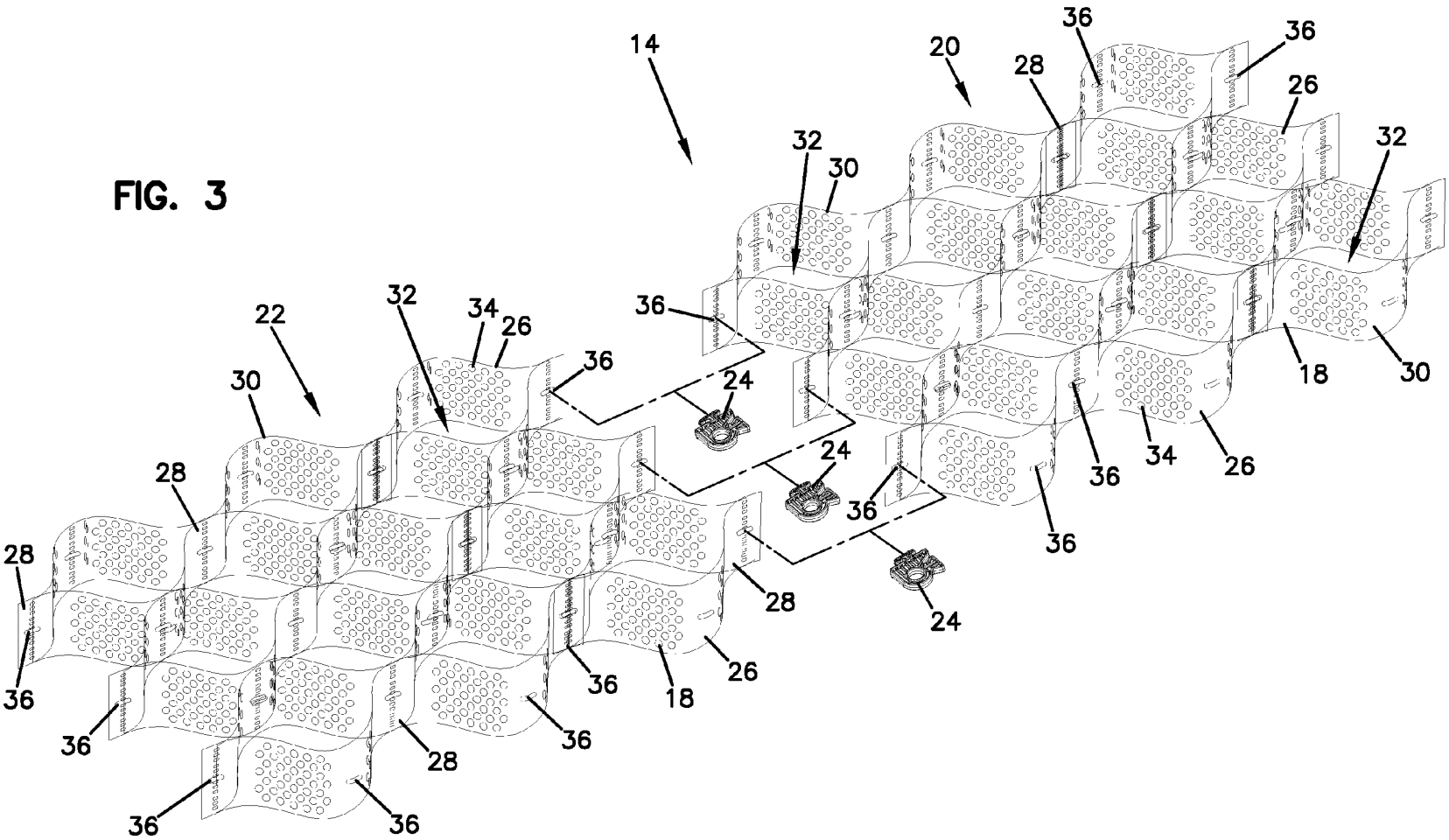
FIG. 3 is a schematic, exploded perspective view of a cellular confinement system and connector devices, depicting the device being used to connect two cellular confinement sections together, prior to assembly end-to end, utilizing principles in accordance with this disclosure.
Figure 4:
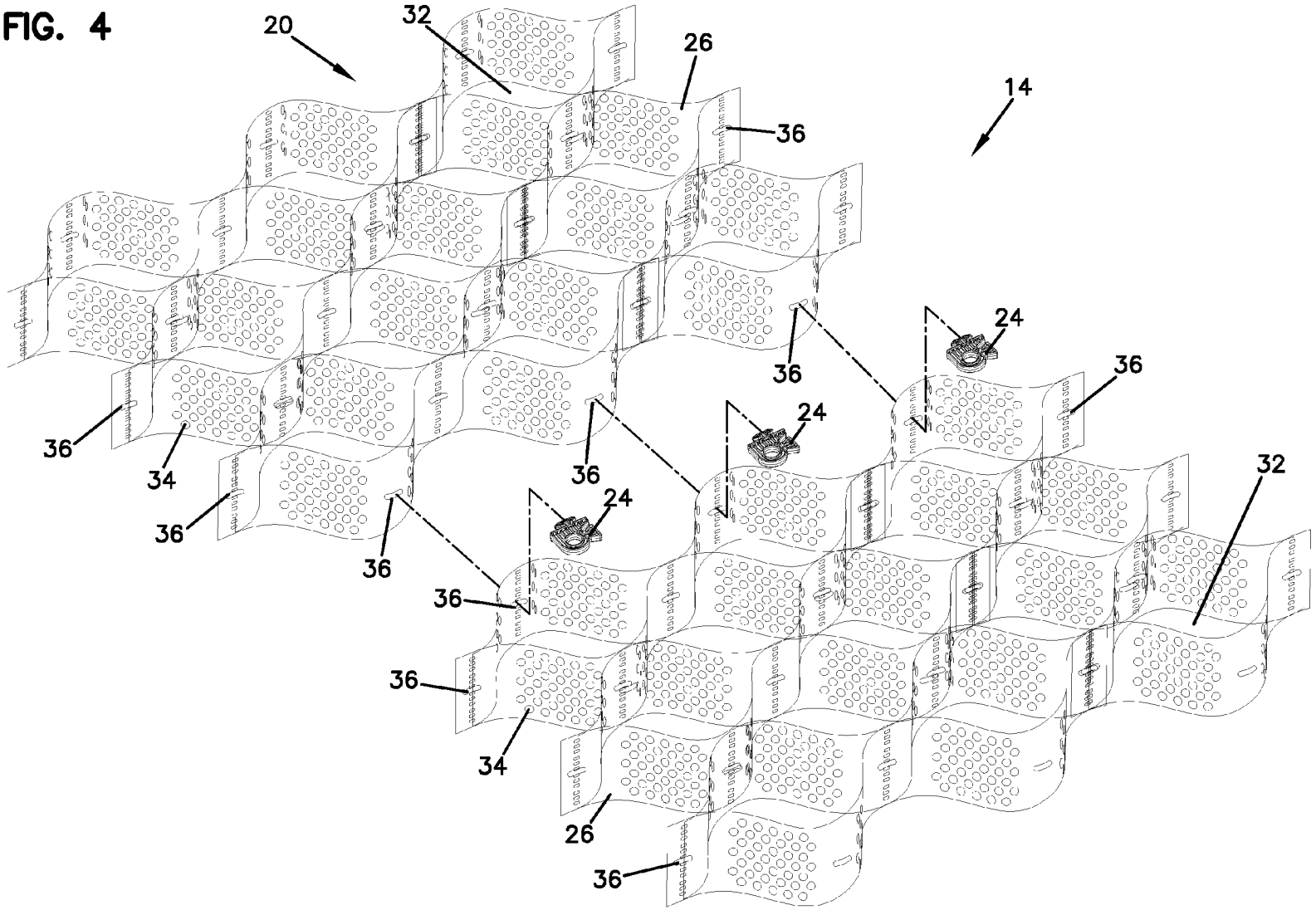
FIG. 4 is a schematic, exploded perspective view of a cellular confinement system and connector devices, depicting the device being used to connect two cellular confinement sections together, prior to lateral assembly, utilizing principles in accordance with this disclosure.

In FIGS. 1-4, there is depicted a cellular confinement system 14. In the particular implementation shown, the cellular confinement system 14 includes a cellular confinement section or structure 18 of cells. At least a first cellular confinement section 18 of cells is shown at 20. In FIGS. 3 and 4, at least a second cellular confinement section 18 of cells is shown at 22. In the embodiment shown, the cellular confinement system 14 further includes at least one load transfer or connector device 24 for transferring load exerted by the expanded and filled section 18 of cells to tendons 78. The tendons 78 may be anchored by stakes (not shown) or other methods.

Each of the expanded cellular confinement structures 18 has a plurality of strips of plastic 26 that are bonded together, one strip to the next at alternating and equally spaced bonding areas 28 to form cell walls 30 of individual cells 32. When the plurality of strips 26 are stretched in a direction perpendicular to the face of the strips, the strips 26 bend in a curved pattern, such as a sinusoidal manner, and form sections 18 of cells 32 in a repeating cell pattern. Each cell 32 has a cell wall 30 that is made up from one strip 26 and a cell wall 30 made from a different strip 26.

In this embodiment, the strips 26 define slots 36. The slots 36 can be used to accommodate the tendons 78 to reinforce the sections 18 and improve the stability of the installation of the cellular confinement section 18 by acting as continuous, integral anchoring members to prevent unwanted displacement of the sections 18. The slots 36 can also be used to help secure the device 24 to the section 18, thereby permitting the device 24 to transfer load from the section 18 to the tendons 78. The device 24 can be seen in FIGS. 1 and 2 penetrating or passing through slot 36 with part of the device 24 seen in phantom lines on a first side 55 (FIG. 2) of cell wall 30, while another portion of the device 24 can be seen on a second side 56 (FIG. 2) of the cell wall 30.

The strips 26 can also define apertures 34. The apertures 34 may help to allow for aggregate interlock and for improved drainage while maintaining sufficient wall stiffness for construction site infilling. Advantageous aperture sizes and patterns are described in U.S. Pat. No. 6,395,372, incorporated by reference herein.

In the embodiment of FIGS. 3 and 4, the device 20 is depicted doing the additional function of connecting or fastening together the first section 20 and second section 22. FIG. 3 shows the system 14 before the first and second sections 20, 22 are connected together in an end-to-end manner. FIG. 4 shows the system 14 before the first and second sections 20, 22 are connected together side-by-side (laterally).

Figure 13:
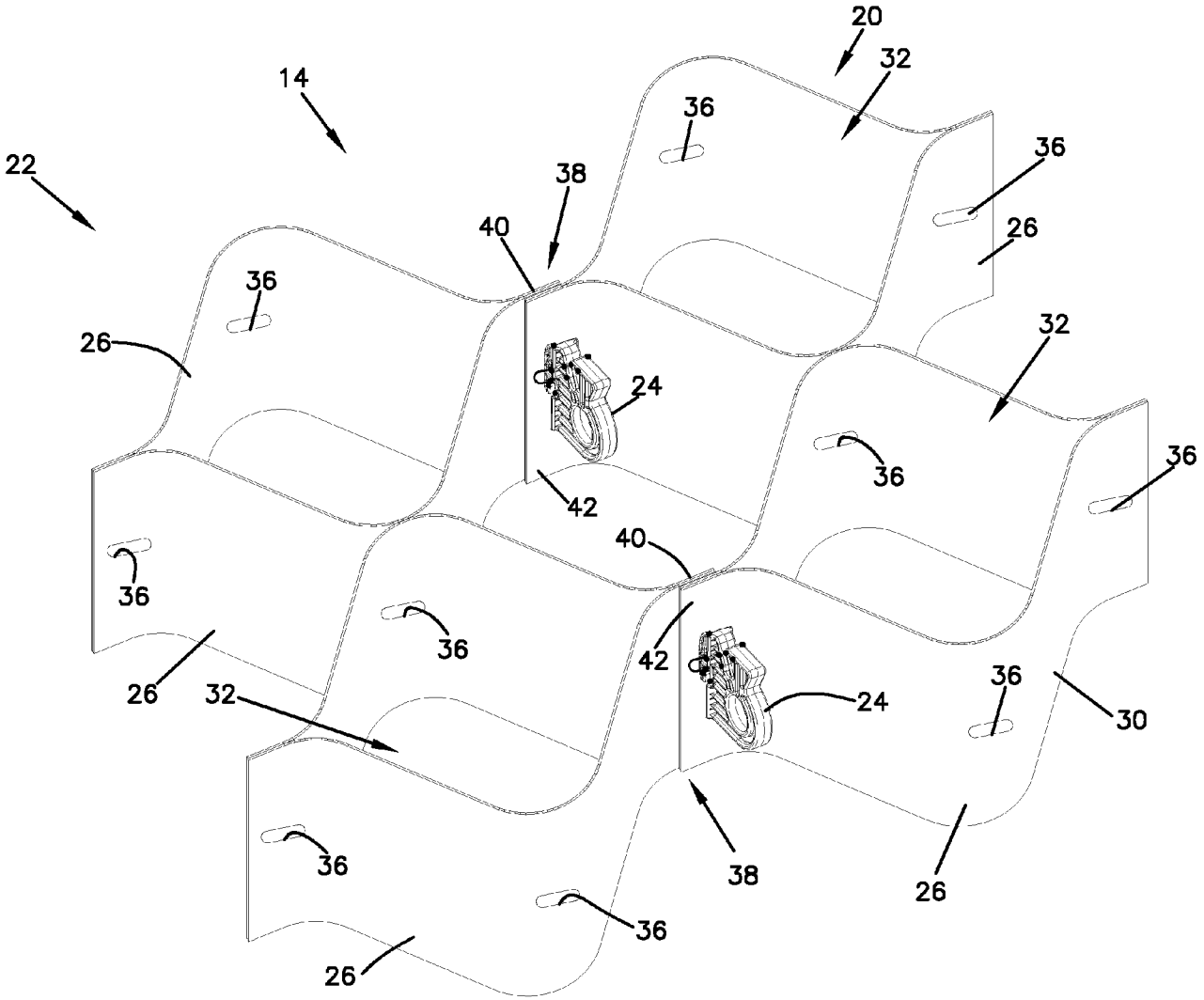
FIG. 13 is a perspective view of two expanded cellular confinement structures connected together utilizing devices, used as connectors, constructed in accordance with principles of this disclosure.

FIG. 13 shows the cellular confinement system 14 with the first section 20 and the second section 22 fastened together by connection device 24. In the embodiment of FIG. 13, at least one device 24 is used, and as shown, plural devices 24 are used. The cells 32 in FIG. 13 differ somewhat from the depiction in FIGS. 1-4, in that the strips 26 in FIG. 13 do not contain all of the apertures 34 as depicted in FIGS. 1-4. The apertures 34 can be used optionally, depending upon the implementation. The option depicted in FIG. 13 does not show apertures 34 in the strips 26. FIG. 13 does depict, however, the open slots 36 defined by the cell walls 30 in the strips 26.

Figure 14:
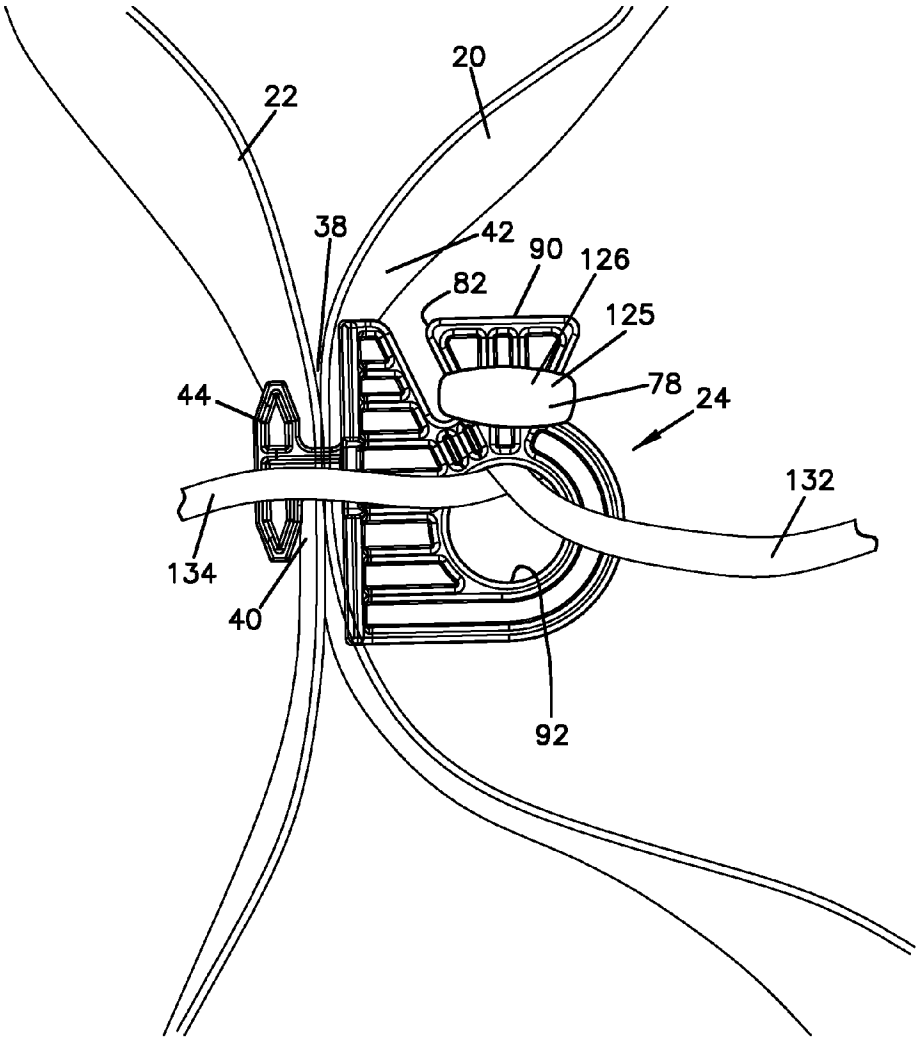
FIG. 14 shows the device of FIGS. 5 and 6 connecting together two cellular confinement sections.

Still in reference to FIG. 13, a cell overlap region 38 is depicted. In particular, there are two cell overlap regions 38 depicted. The cell overlap region 38, as shown, includes an open slot 36 of the first unitary web of cells 20 aligned with open slot 36 of the second unitary sections of cells 22. The cell overlap region 38 defines a first side 40 and an opposite second side 42. The connector device 24 can be seen penetrating or passing through the overlap region 38 with part of the device 24 shown in phantom on the first side 40 of the overlap region 38, while another portion of the device 24 can be seen on the second side 42 of the overlap region 38. Tendons 78, which are preferably used with device 24, are not depicted in FIG. 13, to enhance clarity of the view of the devices 24 with the sections 20, 22. Tendon 78 is shown in FIG. 14 with the device 24 connecting together the first and second sections 20, 22. Preferred uses of the tendon 78 with the load transfer device 24 are further described below.

Example Embodiment of Device 24

Figure 5:
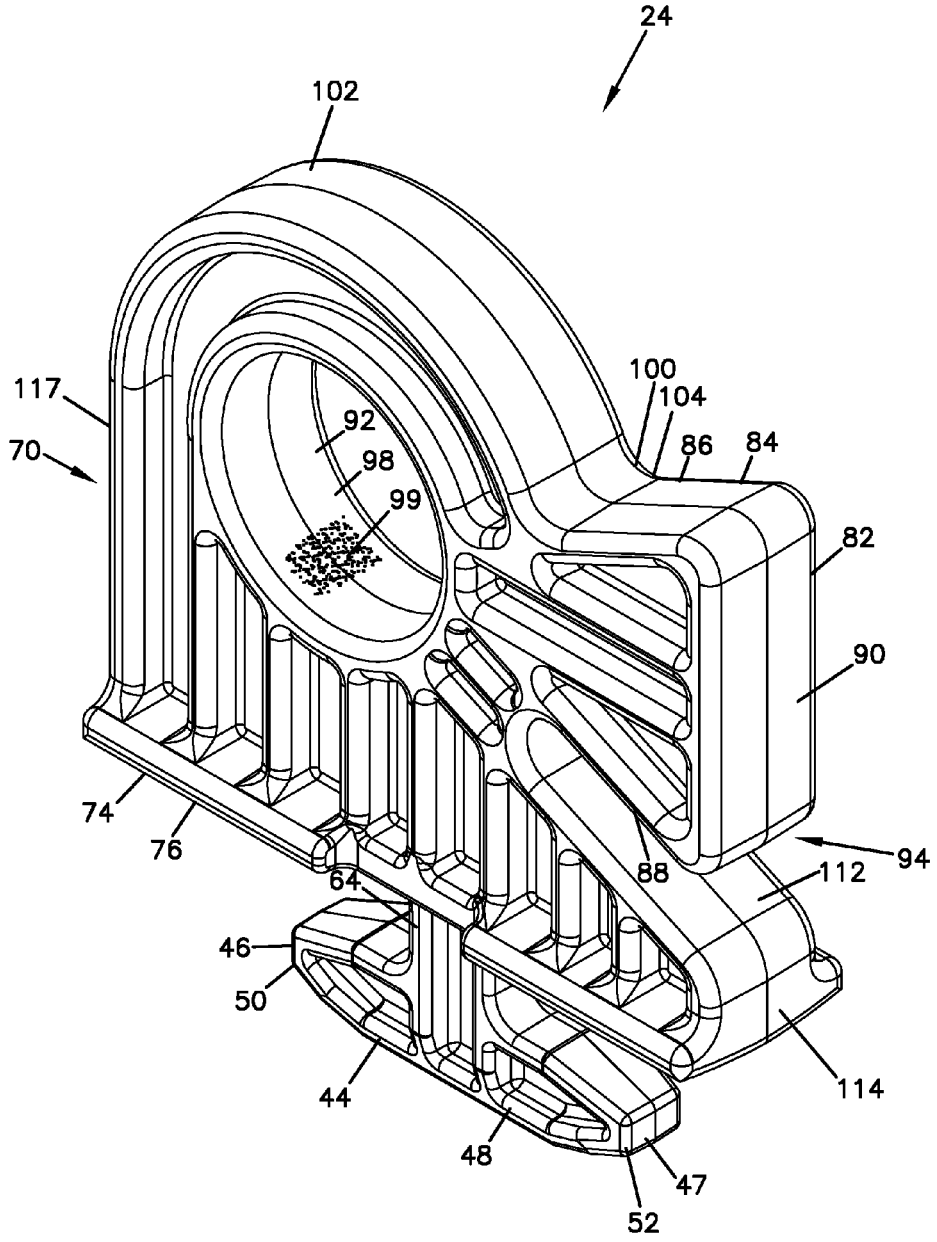
FIG. 5 is a perspective view of one embodiment of a load transfer or connector device constructed in accordance with principles of this disclosure.
Figure 6:
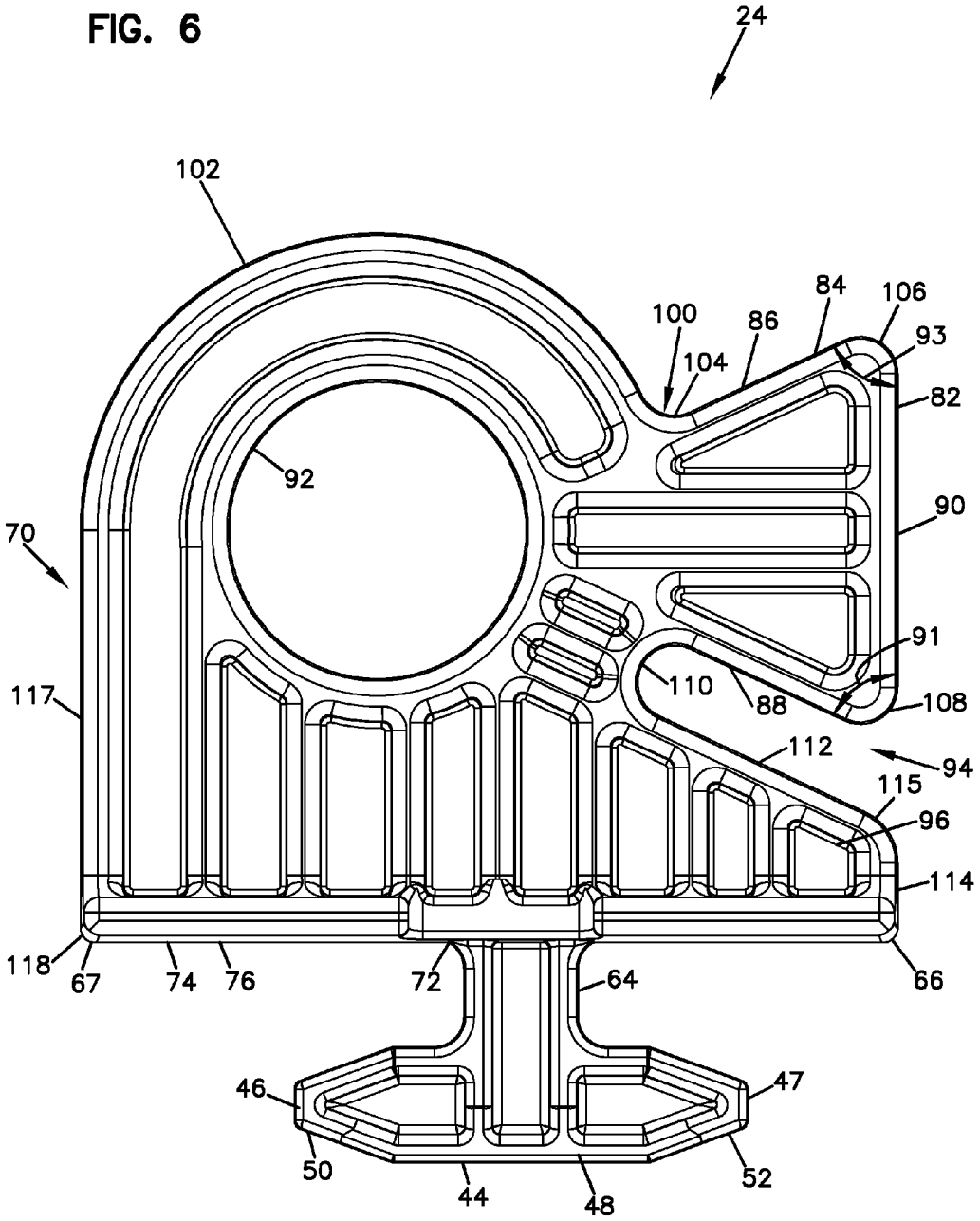
FIG. 6 is a front view of the device of FIG. 5.

Attention is directed to FIGS. 5 and 6. FIGS. 5 and 6 depict one example embodiment of load transfer or connector device 24. In the embodiment depicted, the device 24 includes an insertion member 44. The insertion member 44 has first and second opposite insertion ends 46, 47 and an insertion member extension 48 between the first insertion member end 46 and second insertion member end 47. A first length is defined by the distance between the first insertion member end 46 and second insertion member end 47.

In one embodiment, the first insertion member end 46 has a generally tapered shape 50. This shape 50 provides a convenient and expedited use of the device 24 allowing for maximum width of the insertion member. In this embodiment, the second insertion end 47 is depicted as having a tapered shaped 52. This shape can help provide a fast and convenient use of the device 24 when connecting together and first and second sections 20, 22.

Still in reference to FIGS. 5 and 6, one example device 24 includes an integral shank 64 extending from the insertion member 44 and being spaced from each of the first and second insertion member ends 46, 47. A variety of implementations are possible. In the embodiment depicted, the shank 64 extends generally perpendicular from the insertion member 44.

The shank 64 has a length that is defined as being between the insertion member 44 and a body 70, described below. The length of the shank 64 is less than the length of the insertion member 44, in one example.

In the embodiment shown, the device 24 includes body 70. Preferably, the body 70 is integral with the shank 64. The body 70 extends from the shank 64 at an end 72 of the shank 64 remote from the insertion member 44.

Figure 9:
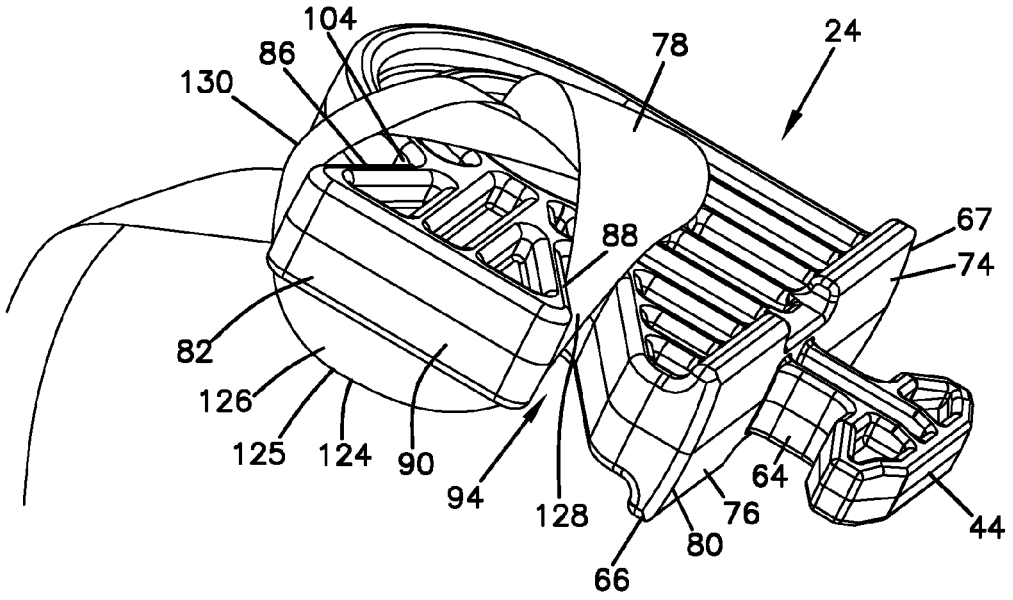
FIG. 9 shows another step of using a tendon with the load transfer device of FIGS. 5 and 6.

In this embodiment, the body 70 includes a face 74 (FIG. 9). The face 74 opposes the insertion member 74. The face 74 spans from an end 66 to an opposite end 67 and can form a bearing surface 76. The bearing surface 76 offers increased load distribution of the forces upon the insertion member 44, once placed in use. As the cells sections 18 exert a force downslope, the device 24 receives the force upon its face 74 and bearing surface 76 and transfers the force to the tendon 78, which in turn transfers the force to stakes (not shown) or to deadman anchor systems (not shown).

In use, the bearing surface 76 can be helpful in holding the load transfer device 24 in place while threading a tendon 78 (FIGS. 7-13) through the connection 24. That is, in one embodiment, the bearing surface 76 helps to hold the load transfer device 24 relative to the section 18 so that two hands may be used to handle the tendon 78, and no hand is needed to hold the load transfer device 24 relative to the section 18.

Figure 12:
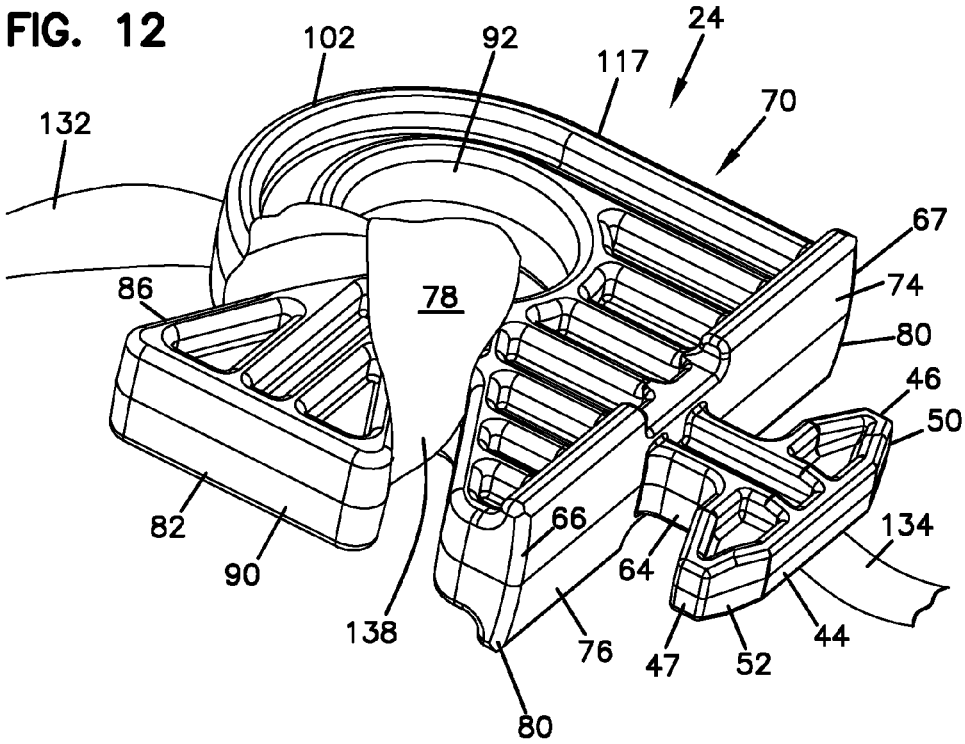
FIG. 12 shows the load transfer device and tendon of FIG. 11, but from the opposite side of the load transfer device.

In FIGS. 9 and 12, it can be seen how in the example embodiment shown, the face 74 may have a slight radius 80 to help make contact uniform and spread the load across the bearing surface 76. In preferred embodiments, the overall length of the face 74 is greater than the length of the insertion member 44. In preferred embodiments, the overall width or thickness of the face 74 is greater than the width or thickness of the insertion member 44.

In reference again to FIGS. 5 and 6, the body 70 includes a post 82. The post 82 can include a tendon-receiving holding surface 84. As can be seen in FIGS. 9-12, the post 82 is shaped to allow for the tendon receiving holding surface 84 to be wrapped with the tendon 78.

In one embodiment, the post 82 has two opposite sides 86, 88. In the embodiment shown, the sides 86, 88 are angled inwardly as they extend in a direction from an end surface 90 in a direction toward the remaining part of the body 70. That is, the sides 86, 88 angle inwardly in a direction toward each other as they extend toward a through-hole 92 in the body 70.

A variety of angles can be used. In the embodiment shown, the two opposite sides 86, 88 of the post 82 are angled at angles 91, 93 respectively (FIG. 6) about 55-75 degrees relative to the end surface 90. Angles 91, 93 are illustrated as being equal, but in other embodiments, they do not need to be equal and can vary. The angle of side 88 relative to the face 74 is illustrated as being about 15-35 degrees and can vary.

The body 70 includes an open slot 94. In the embodiment shown, the slot 94 is between the post 82 and the face 74. Specifically, in the illustrated embodiment, the slot 94 is between the side 88 of the post 82 and a portion 96 (FIG. 6) of the body 70 that is adjacent to the face 74. The slot 94 helps to hold the tendon 78 in place. This is described further below.

As mentioned above, the body 70 includes the through-hole 92. The through-hole 92 is sized to receive the tendon 78, and it is especially useful to receive plural parts of the tendon 78.

The inside radial surface 98 of the through-hole 92 can be roughened to form a roughened surface 99 (FIG. 5) to help provide enhanced grip and friction between the through-hole 92 and the tendon 78. In FIG. 5, only a portion of the inside radial surface 98 is illustrated with the roughened surface 99, but it should be understood that in some embodiments, most or the entire inside radial surface 98 can be roughened. In addition, or alternatively, an additive can be put into a polymer mix that is used to make the device 24, to result in the device 24 having a roughened external surface throughout, ensuring that every part of the device 24 that comes into contact with the tendon 78 is roughened to enhance the grip and friction between the device 24 and the tendon 78.

In the embodiment shown, the through-hole 92 is circular. Of course, in other embodiments, the shape of the through-hole 92 can vary, and it need not necessarily be circular. In this embodiment, the circular through hole has a diameter that is about 50-80% of the length of the insertion member 44. The diameter of the through-hole 92 is about 110-150% of the length across a narrowest length 100 (the waist 100) (FIG. 6) of the post 82.

As can be seen in FIG. 6, the through-hole 92 is generally laterally adjacent to the post 82, but can be offset to reduce the tendency for rotation of the load transfer device upon loading of the tendon.

The body 70 has a shape that is advantageous in using it with tendon 78. In the example shown, the perimeter shape includes a first section 102 that is radiused, and in some embodiments, semi-circular. Adjacent to the first section 102 is second section 104, which has a radius opposite of the radius of the first section 102. Second section 104 also corresponds to waist 100, which is the narrowest section across the length of the post 82. Extending from the second section 104 is the first side 86 of the post 82. A third radiused section 106 is between the side 86 and end surface 90. A fourth radiused surface 108 is between the end surface 90 and the side 88. A fifth radiused section 110 extends from the side 88 to a side 112. The side 112 forms one side 112 of the slot 94. That is, the slot 94 is defined by side 88, section 110, and side 112. Sixth section 114 is between the side 112 and face 74. A radiused portion 115 can be between the side 112 and sixth section 114. Extending from the face 74 is seventh section 117. Seventh section 117 is generally straight and extending from the face 74 to the first section 102. Between the seventh section 117 and the face 74, can be a radiused portion 118.

The body 70 is spaced from the insertion member 44 a distance about 5-30% of the length of the insertion member 44. This provides room for manipulating the device 24 relative to the slots 36 in the section 18.

The device 24 can be made from a variety of materials including a molded plastic of resin based material, or a metal.

Methods and Example Uses of Tendon 78

In reference again to FIG. 2, it can be seen that in use, the device 24 will have the insertion member 44 (shown in phantom in FIG. 2) on the first side 55 of the cell wall 30 and the body 70 on the second side 56 of the cell wall 30. The shank 64 extends through the slot 36. Methods of using the device 24 are described further below.

Figure 7:
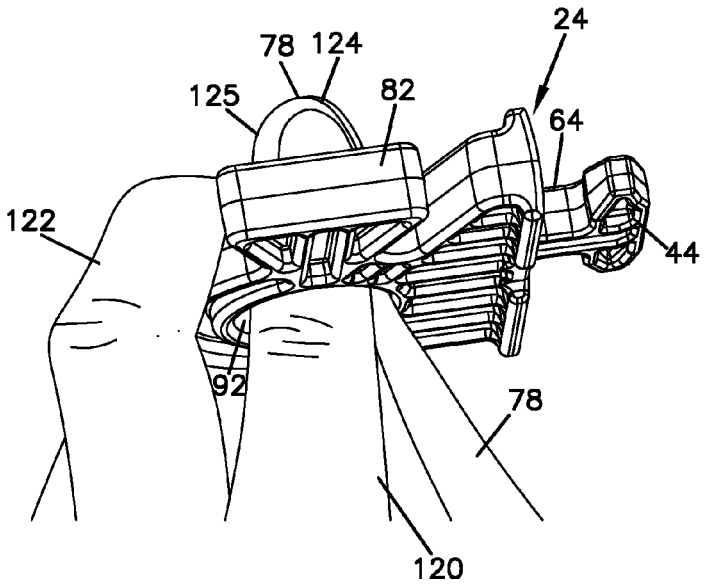
FIG. 7 shows one step of using a tendon with the device of FIGS. 5 and 6.

One example method includes securing the load transfer device 24 to the cell wall 18 and transferring the load to tendons 78. As shown in FIGS. 7-12, the tendon 78 can be inserted through the through-hole 92 in the body 70. FIG. 7 illustrates tendon 78 being inserted through the through-hole 92. In FIG. 7, fingers 120 and 122 can be seen manipulating the tendon 78 relative to the load transfer device 24. The finger 120 has pushed the tendon 78 through the through-hole 92 and formed a loop 125. A bight section 124 of the loop 125 can be seen in FIG. 7.

Figure 8:
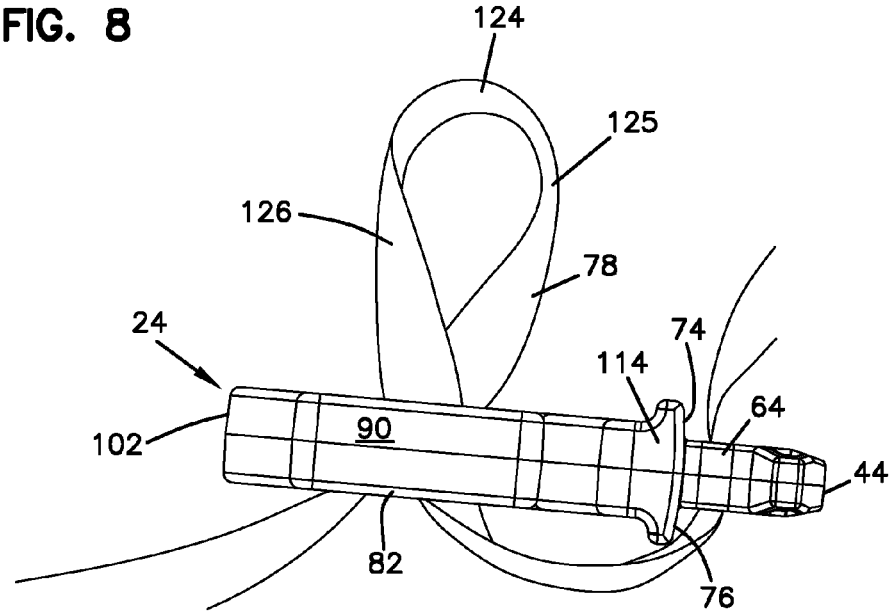
FIG. 8 shows another step of using a tendon with the device of FIGS. 5 and 6.

FIG. 8 illustrates another step in a process of using tendon 78 to secure the load transfer device 24 and the web of cells 18. In FIG. 8, the tendon 78, after it has been pushed through the through-hole 92 and the loop 125 formed, the tendon 78 is twisted at least once to form twisted section 126. Generally, the twisted section 126 is formed by twisting the tendon 78 180°

In FIG. 9, another step of using the tendon 78 is shown. The tendon 78 is oriented over the post 82. In the example shown in FIG. 9, after twisted section 126 is formed, the twisted section 126 is wrapped around or placed over and around the post 82. It can be seen how the tendon 78 passes through the through-hole 92, and then a first part 128 of the tendon 78 passes in the slot 94, while a second part 130 is located adjacent to the second section 104 of the body 70. The angled sides 86, 88 of the post 82 help to hold the tendon 78 in place.

Figure 10:
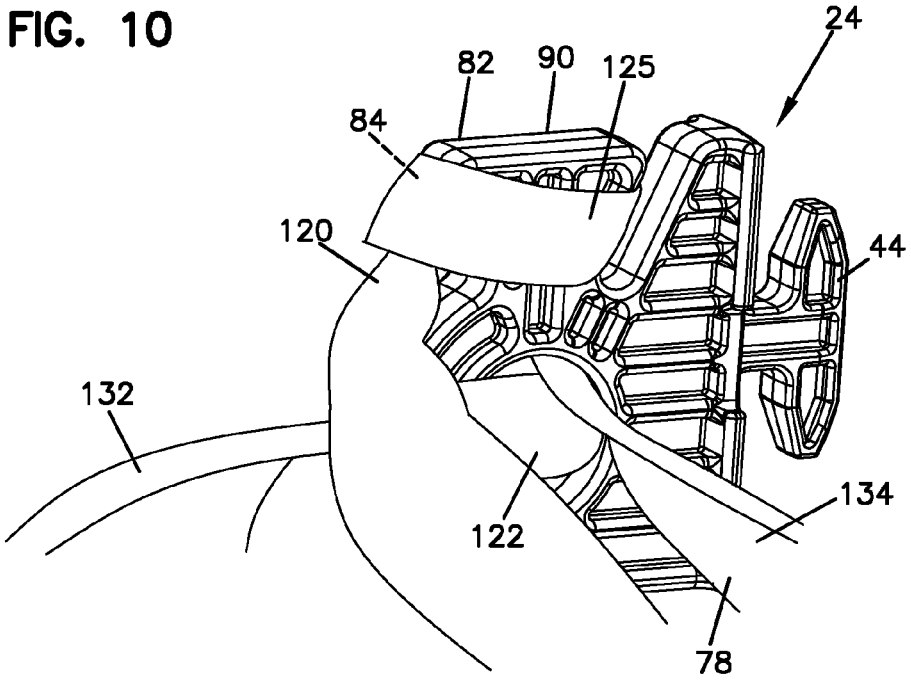
FIG. 10 shows another step of using a tendon with the load transfer device of FIGS. 5 and 6.

FIG. 10 illustrates another step of using tendon 78 to secure the device 24 and the web of cells 18. In FIG. 10, after the loop 125 has been inserted through the through-hole 92, in the body 70 of the device 24, and then wrapped around the post 82, the tendon 78 is pulled to cinch the tendon 78 on the post 82. For example, a downstream side 132 of the tendon 78 is pulled, which will cause the loop 125 to tighten around the post 82. An upstream side 134 of the tendon is also visible in FIG. 10. Fingers 120 and 122 can be seen in FIG. 10 manipulating the tendon 78.

Figure 11:
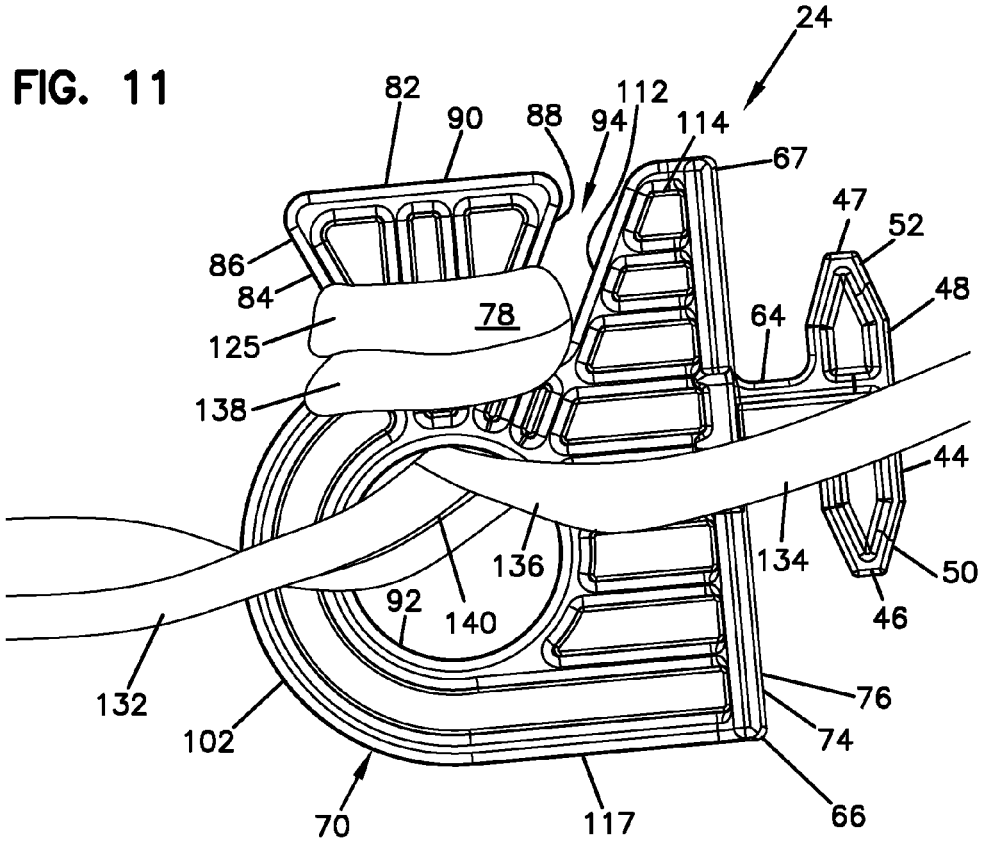
FIG. 11 shows another step in using a tendon with the load transfer device of FIGS. 5 and 6.

FIGS. 11 and 12 show the tendon 78 in the finished and secured position from opposite sides of the load transfer device 24. The tendon 78 has a first tendon section 136 (FIG. 11) extending through the through-hole 92 in a first direction, a second tendon section 138 wrapped around the post 82, and a third tendon section 140 (FIG. 11) extending through the through-hole 92 in a second direction opposite of the first direction.

Figure 15:
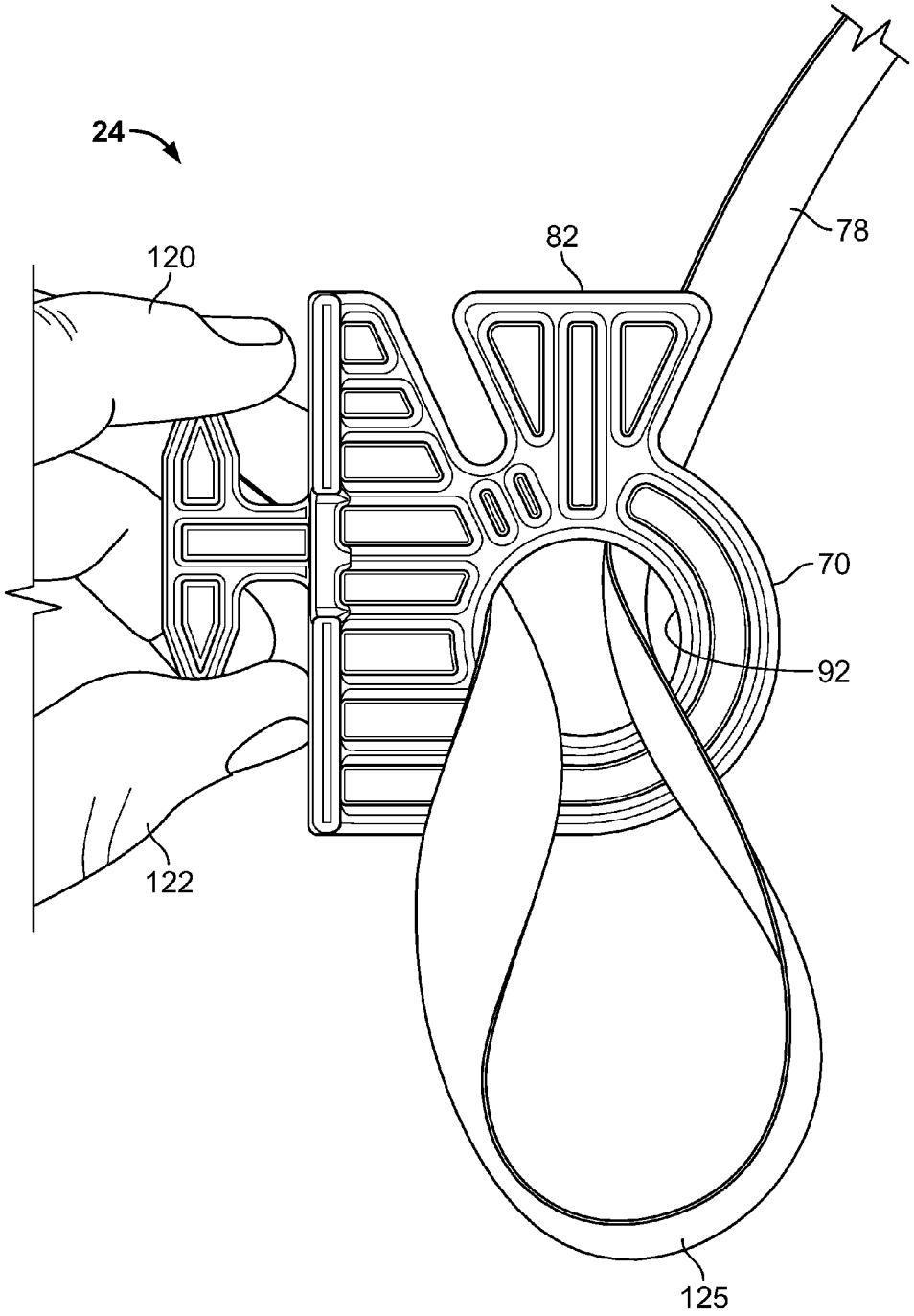
FIGS. 15-20 show steps in another method of using a tendon with the device of FIGS. 5 and 6.
Figure 16:
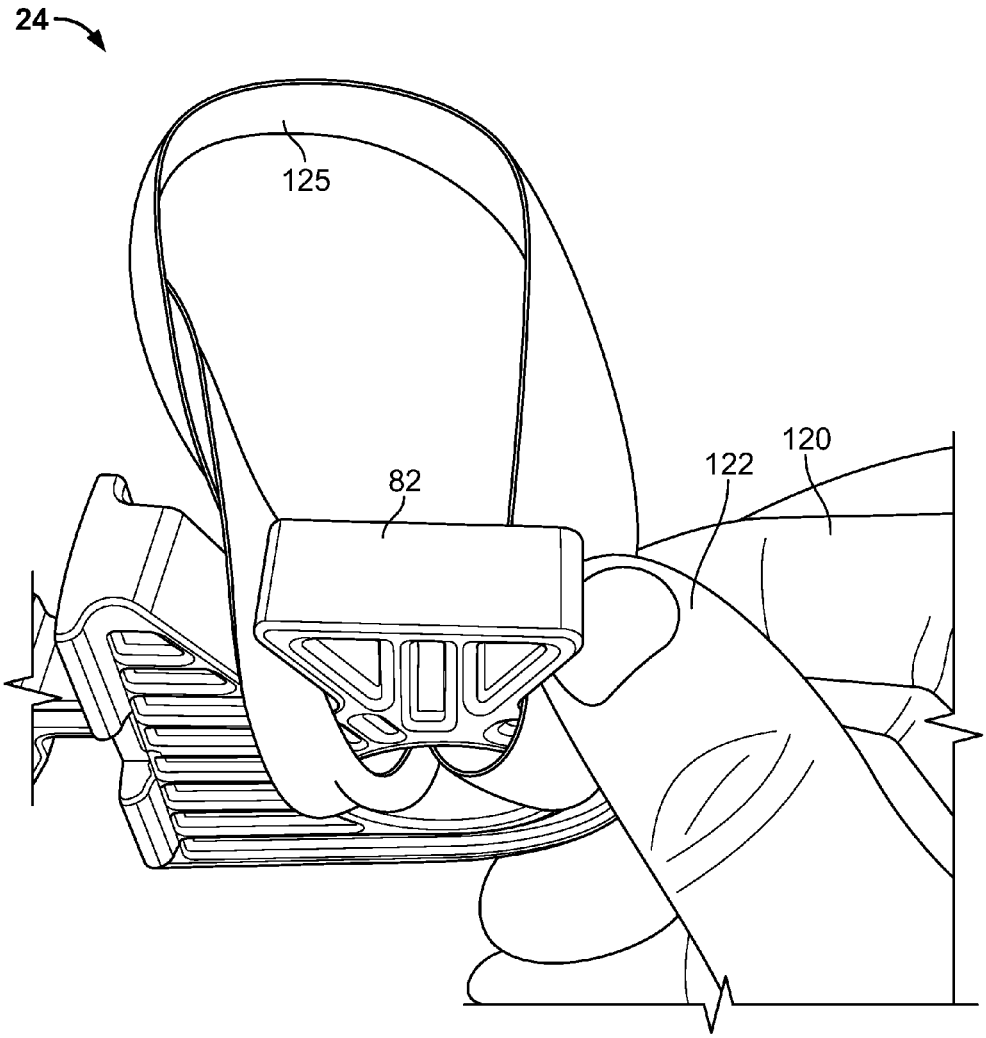
Figure 17:
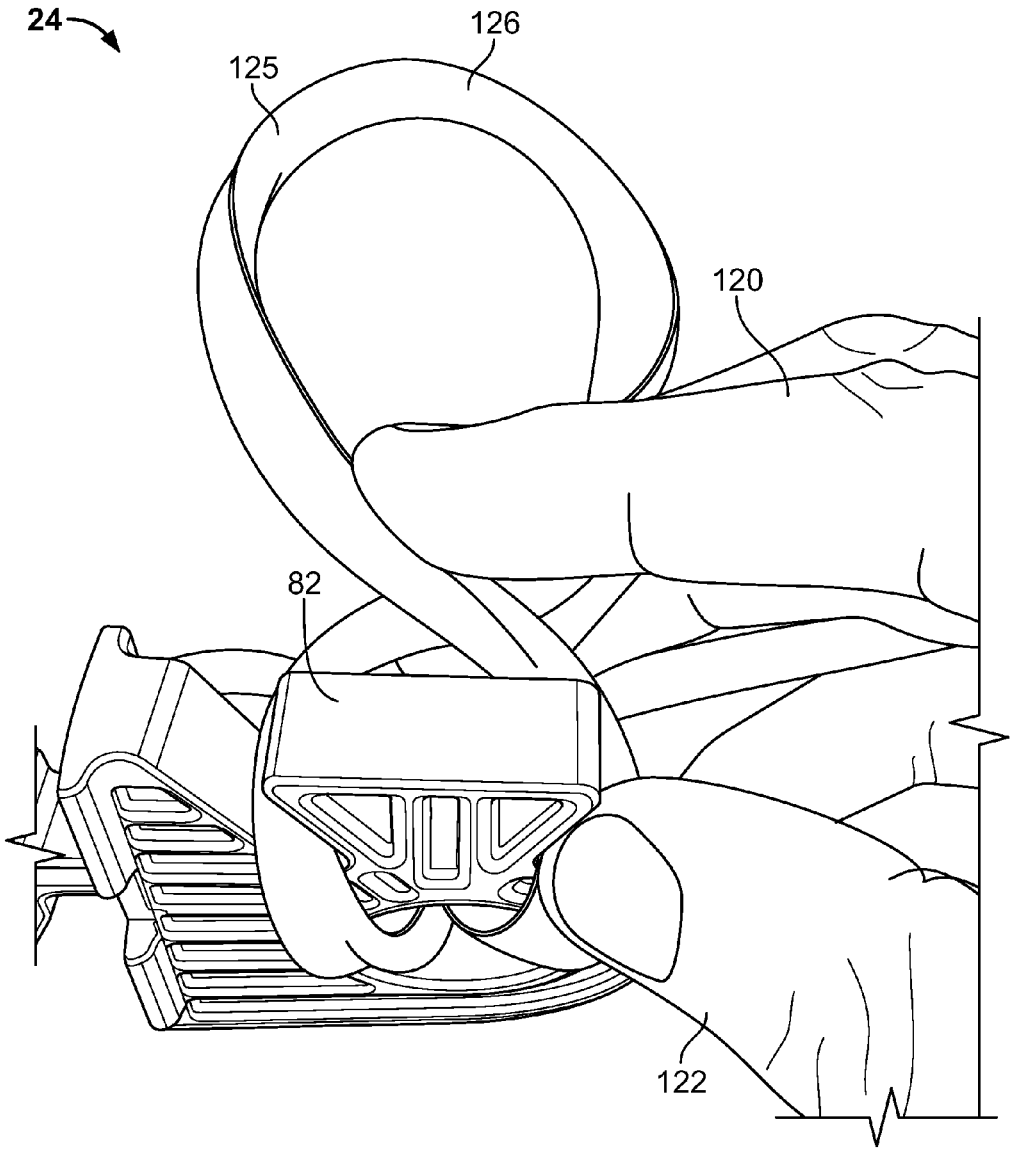
Figure 18:
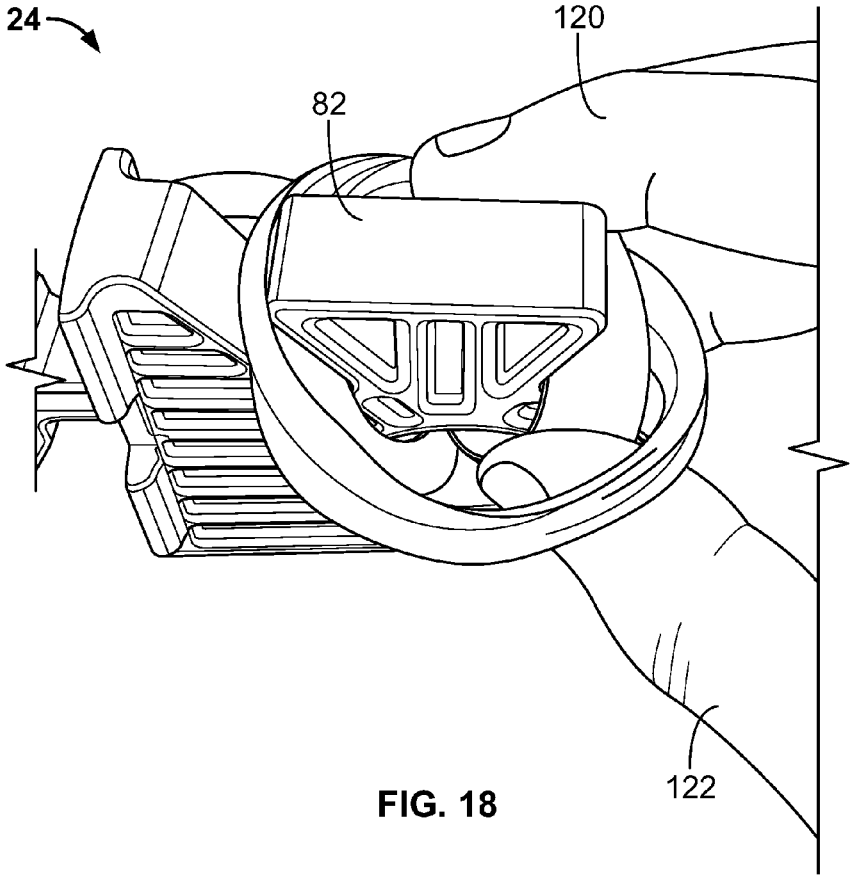
Figure 19:
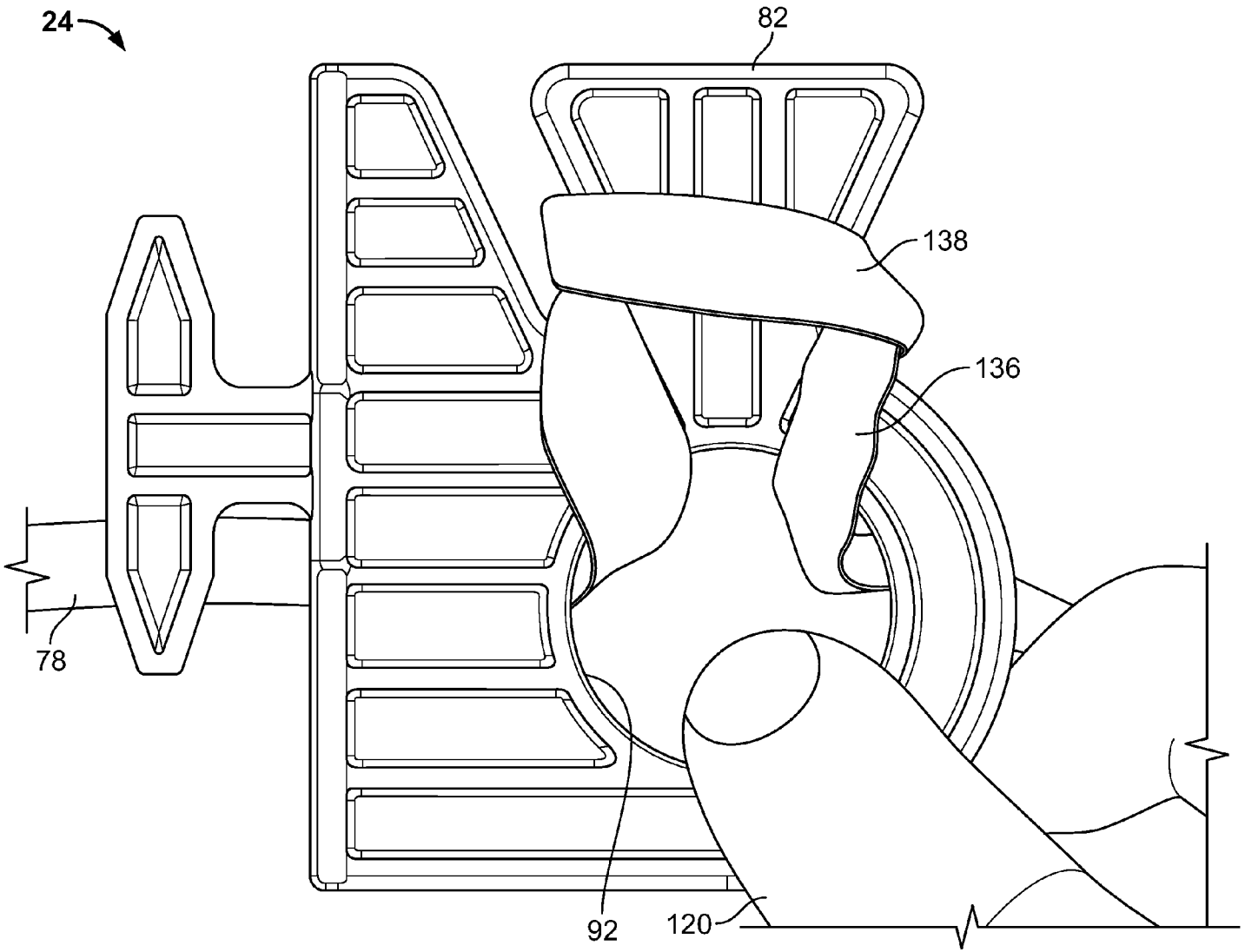
Figure 20:
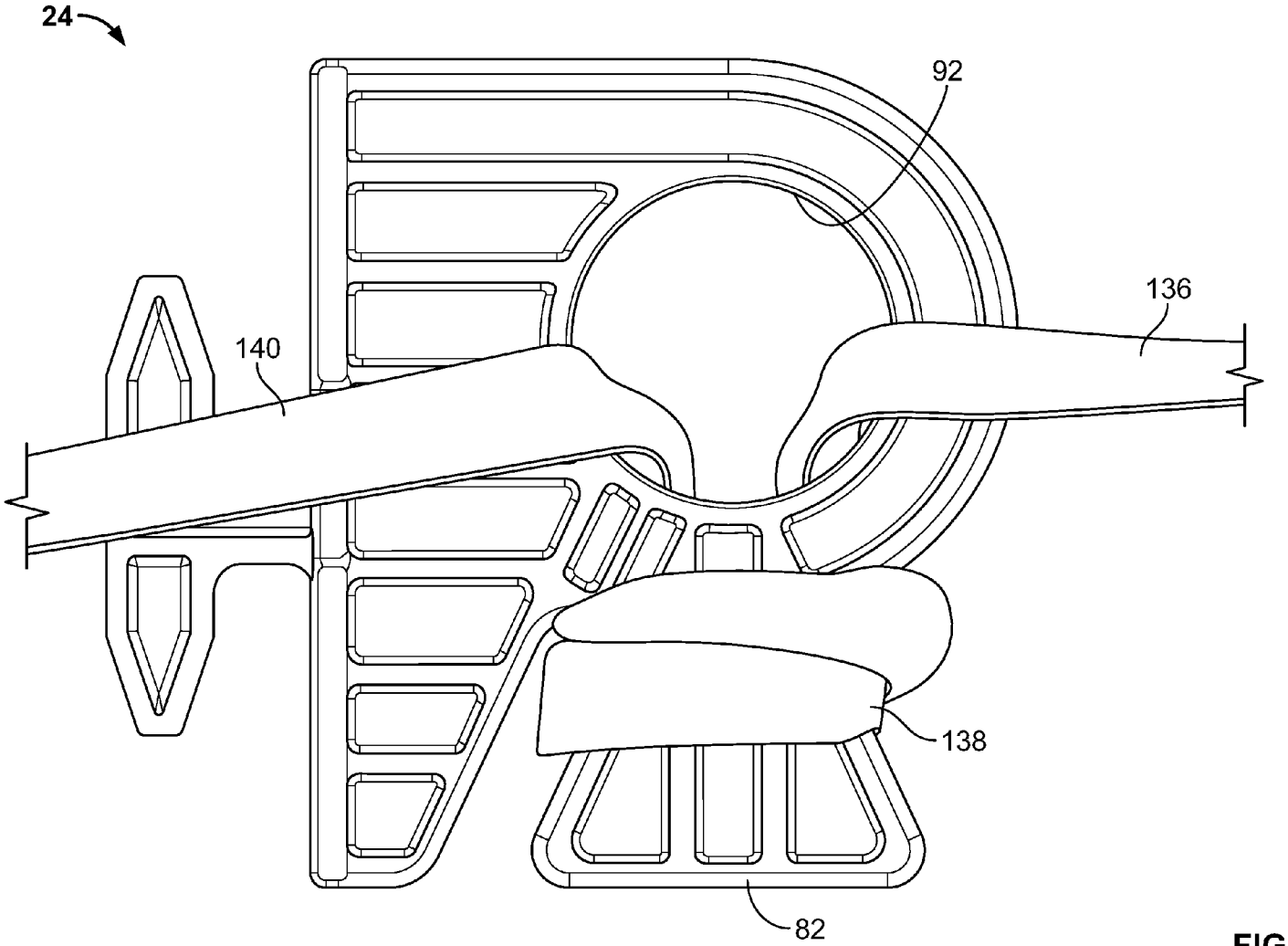

FIGS. 15-20 show another method of using tendon 78 to secure the device 24 and the web of cells 18. In FIG. 15, the loop 125 has been inserted through the through-hole 92, in the body 70 of the device 24. In FIG. 16, the loop 125 is wrapped around the post 82. Next, in FIG. 17, the loop 125 of the tendon is twisted at least once to form twisted section 126. Generally, the twisted section 126 is formed by twisting the tendon 78 180°. Next, in FIG. 18, the twisted section 126 is oriented over the post 82 and then pulled to cinch the tendon 78 around the post 82 (FIGS. 19 and 20). FIGS. 19 and 20 show the tendon 78 in the finished and secured position from opposite sides of the device 24. The tendon 78 has a first tendon section 136 (FIG. 19) extending through the through-hole 92 in a first direction, a second tendon section 138 wrapped around the post 82, and a third tendon section 140 (FIG. 20) extending through the through-hole 92 in a second direction opposite of the first direction. Fingers 120 and 122 can be seen in FIGS. 15-20 manipulating the tendon 78.

In use, a method of transferring load from the expanded cellular confinement structure 18 to flexible tendon 78 can be implemented. The method includes providing the expanded cellular confinement structure 18 having plurality of cells 32 formed by cell walls 30, the cell walls 30 having first 55 and second 56 opposite sides and at least one open slot 36. The method includes inserting insertion member 44 of the device 24 from the second side 56 of the cell wall 30 through the open slot 36 to provide the insertion member 44 on the first side 55 of the cell wall 30; the body 70 of the device 24 on the second side 56 of the cell wall 30; and the shank 64 between the insertion member 44 and the body 70 extending through the slot 36. The method further includes inserting tendon 78 through the through-hole 92 in the body 70 and wrapping the tendon 78 around the post 82 of the body 70.

In use, the device 24 can be utilized to connect or fasten two expanded cell confinement structures 18 together. The method includes aligning two expanded cell confinement structures 18 so that at least one open slot 36 defined by the first web 20 is aligned with at least one slot 36 defined by the second web 22 to form the overlap region 38. The device 24 is used by inserting the insertion member 44 from the second side 42 (FIG. 4) of the overlap region 38 through the aligned open slots 36 in the overlap region 38. This provides the insertion member 44 on the first side 40 of the overlap region 38. The body 70 will be on the second side 44 of the overlap region 38. The shank 64 extends through the overlap region 38.

The method may also include rotating the body 70 to turn or rotate the connector device 24 within the overlap region 38. This helps to lock the device 24 within the slots 36. FIG. 14 shows the device 24 before being turned or rotated, and FIG. 13 shows the device 24 after it has been rotated about 90° relative to the slots 36.

In some implementations, the method can further include a step of using tendon 78 to help further secure the load transfer device 24 to the self-confinement structure 18. In FIG. 14, it can be seen how the device 24 is being used as a connector between first and second sections 20, 22. The insertion member 44 has been inserted or engaged through the slots 36 of two adjacent webs 20, 22, either end- to-end, or edge-to-edge. The tendon 78 is shown from its upstream side 134 extending through the through-hole 92, having loop 125 formed and then twisted to form twisted section 126, wrapped around the post 82, and then the downstream side 132 of the tendon 78 is shown passing back through the through hole 92.

The device 24 has advantages over prior art connectors. The structure of the device allows it to install quickly and be simple to use. The insertion member 44 is helpful in holding the device 24 in position, to allow for the user to use both hands to thread the tendon 78 onto the device 24, making this a faster tie than prior art devices. Once the device 24 is placed through the slots 36 of the adjoining sections 20, 22, the tendon 78 is pulled through the slots 36 and then pulled through the through-hole 92 and wrapped over the post 82, which completes the connection. The user then moves on to the next connection with the tendon 78. The wide face 74 provides bearing surface 76 for exerting a force against the section 18, and this bearing surface 76, in combination with the insertion member 44, helps to hold the device 24 in place so that two hands can be used for the tendon tie.

The parts of this system 14 can be placed together for use in a kit. The kit can include at least first unitary webs of cells 20, as characterized above. The kit can include at least one, and typically a plurality of devices 24 for transferring load from the section 20 to the tendon 78. Each device 24 will include an insertion member 44 having insertion member extension 48, integral shank 64 extending from the insertion member 44, and the integral body 70 extending from the shank 64 at end 72 of the shank 64 remote from the insertion member 44. The body 70 will include post 82 having tendon-receiving holding surface 84 and through-hole 92 sized to receive tendon 78. In preferred implementations, the kit will also include at least one, and preferably, a plurality of tendons 78. The tendon 78 secures the device 24 and the first and second section of cells 20, 22 by looping through the through-hole 92 in the body 70 and wrapping around the post 82.

Strength Testing

Figure 21:
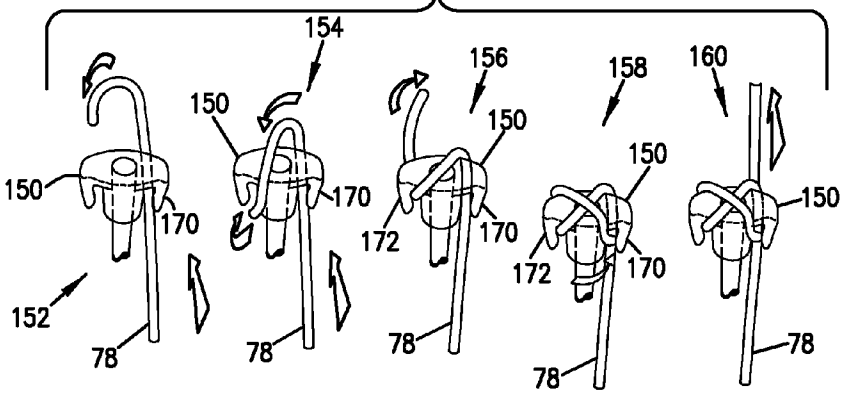
FIG. 21 (PRIOR ART)
FIG. 21 shows prior art steps of securing a prior art device with a tendon.

A test was done on a NIST calibrated tensile testing machine comparing the device 24 to the prior art device 150 (FIGS. 21 and 22) described in U.S. Pat. No. 5,927,906. The prior art device 150 of U.S. Pat. No. 5,927,906 is the device currently sold by the assignee under the tradename Atra® Clip. The device 24 of the present disclosure tested was made from an engineered polymer known generally as "nylon 6 with glass reinforcement." The tendon 78 was made from woven kevlar.

The tensile test equipment used was a Curtis Sure Grip Inc. 10,000 Lb Capacity "Geo Grip," Serial Number G-181 & G-182 and related hydraulic cylinder, air over hydraulic power supply, load cell and digital readout.

A single strip of a perforated cellular confinement section of cells, sold by the assignee under the tradename GEOWEB 20V8, was clamped into the tensile tester jaws with the device 24 engaged through the slot 36 with the tendon 78 secured to the device 24, and with the free end of the tendon 78 clamped into the opposite jaw of the tensile tester. The rate of loading used was 12 inches per minute. There were 4 techniques used to fasten the device 24 to the cellular confinement section, as follows:

Technique A: thread the tendon through the hole 92, then put the tendon over the post 82 (FIG. 16), then twist the tendon once (FIG. 17), and then put the twisted tendon over the post 82 (FIG. 18).

Technique B: thread the tendon through the hole 92, then twist the tendon once (FIG. 8), and then put the twisted tendon over the post 82 (FIG. 9).

Technique C: thread the tendon through the hole 92, then twist the tendon twice, and then put the twice twisted tendon over the post 82.

Technique D: thread the tendon through the hole 92, then twist the tendon twice, then put the twice twisted tendon over the post 82, then cross the tendon over the insertion member 44.

The results were as follows:

| Technique | Max Tensile lbf. | Failure Mode |
|---|---|---|
| A | 547 | device tore through perforations |
| A | 556 | device tore through perforations |
| C | 512 | device tore through perforations |
| B | 524 | device tore through perforations |
| B | 303 | slipped due to short tendon |
| B | 534 | device tore through perforations |
| D | 487 | insertion member snapped off, then tore through perforations |
| C | 502 | device tore through perforations |
| C | 496 | device tore through perforations/ insertion member deflected |

An additional test was run using a single strip of a non-perforated cellular confinement section of cells and having slots 36. Again, the strip was clamped into the tensile tester jaws with the device 24 engaged through the slot 36 with the tendon 78 secured to the device 24, and with the free end of the tendon 78 clamped into the opposite jaw of the tensile tester. The rate of loading used was 12 inches per minute. The result was as follows:

| Technique | Max Tensile lbf. | Failure Mode |
|---|---|---|
| A | 648 | device tore through the strip |

Figure 22:
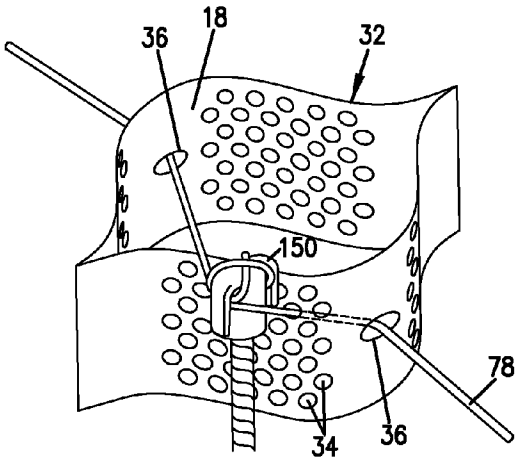
FIG. 22 (PRIOR ART)
FIG. 22 shows the prior art device secured to a cellular confinement structure with the prior art technique of FIG. 21.

To test the prior art device 150 of U.S. Pat. No. 5,927,906, currently sold by the assignee under the tradename Atra® Clip, a single strip of a perforated cellular confinement section of cells, sold by the assignee under the tradename GEOWEB 20V8, was clamped into the tensile tester jaws with the Atra® Clip device 150 secured with the tendon 78 by use of a "Moore hitch." Specifically, and in reference to FIGS. 21 and 22, at step 152, the tendon 78 was placed under a first arm 170 of the device 150. At step 154, the tendon 78 was diagonally crossed over the top of the device 150. At step 156, the tendon 78 was placed under the second arm 172 and pulled to remove slack. At step 158, the tendon 78 was diagonally crossed back over the top of the device 150 and placed under the first arm 170. At step 160, the tendon 78 was pulled to remove any slack. FIG. 22 shows the prior art Atra® Clip device 150 secured with tendon 78 to cell 32. In the test, the free end of the tendon 78 was clamped into the opposite jaw of the tensile tester. The rate of loading used was 12 inches per minute. The results were as follows:

| Technique | Max Tensile lbf. | Failure Mode |
|---|---|---|
| Moore hitch | 241 | device pulled through slot 36 |
| Moore hitch | 246 | device pulled through slot 36 |

The device 24 of the present disclosure, made from the nylon 6 with glass reinforcement, resulted in pull through loadings (tensile strength) of more than 80%, indeed at least 100% greater than that of the device of U.S. Pat. No. 5,927,906, in most instances.

The above provides a complete description. Many embodiments can be made.

What is claimed is:

1. A device for use with at least one expanded cellular confinement structure; the device comprising:

(a) an insertion member having first and second opposite insertion ends;

(b) an integral shank extending from the insertion member and being spaced from each of the first and second insertion ends; and (c) an integral body extending from the shank at an end of the shank remote from the insertion member; the body including:

(i) a face opposing the insertion member;

(ii) a post with a tendon-receiving holding surface; and (iii) a through hole with a closed periphery sized to receive a tendon.

2. The device of claim 1 wherein:

(a) the insertion member has a length defined between the first and second insertion ends; and (b) the face has a length longer than the length of the insertion member.

3. The device of claim 1 wherein:

(a) the face has a thickness greater than a thickness of the insertion member.

4. The device of claim 1 wherein:

(a) the body has an open slot between the post and the face.

5. The device of claim 1 wherein:

(a) the post has two opposite sides angled inwardly as they extend in a direction toward the through hole.

6. The device of claim 5 wherein:

(a) the two opposite sides of the post are angled 15-35° relative to the face.

7. The device of claim 1 wherein:

(a) the shank is perpendicular relative to the insertion member and the face.

8. The device of claim 1 wherein:

(a) the insertion member has a length defined between the first and second insertion ends; and (b) the through hole is circular and has a diameter 50-80% of the length of the insertion member.

9. The device of claim 1 wherein:

(a) the through hole is circular and has a diameter 110-150% of the length of across a narrowest length of the post.

10. The device of claim 1 wherein:

(a) the insertion member has a length defined between the first and second insertion ends; and (b) the body is spaced from the insertion member a distance 5-30% of the length of the insertion member.

11. A cellular confinement system comprising:

(a) at least a first unitary section of cells made from elongated plastic strips bonded together in spaced apart areas; the strips forming walls of the cells; at least some of the cell walls defining open slots;

(b) at least one device oriented in a first one of the slots; the device including:

(i) an insertion member having first and second opposite insertion ends;

(A) the insertion member being located on a first side of the cell wall within the first one of the slots;

(ii) an integral shank extending from the insertion member and being spaced from each of the first and second insertion ends;

(iii) an integral body extending from the shank at an end of the shank remote from the insertion member;

(A) the body being located on a second side of the cell wall within the first one of the slots;

(B) the body including a face bearing against a portion of the second side of the cell wall adjacent to the first one of the slots; and (C) the body including a post and a through-hole with a closed periphery; and (c) at least one flexible tendon extending through at least the first one of the slots;

the at least one flexible tendon extending through the through-hole in the body of the device, and being wrapped around the post of the body.

12. The cellular confinement system of claim 11 wherein:

(a) the tendon has a first tendon section extending through the through-hole in a first direction, a second tendon section wrapped around the post, and a third tendon section extending through the through-hole in a second direction opposite of the first direction.

13. The cellular confinement system of claim 11 wherein:

(a) the at least one device includes a plurality of devices, each device oriented in a different one of the slots of the cell walls.

14. The cellular confinement system of claim 13 wherein:

(a) the tendon extends between at least selected devices in the plurality and is secured to the selected devices by being extended through a respective through-hole in a first direction, wrapped around a respective post, and extended through the respective through-hole in a second direction.

15. The cellular confinement system of claim 11 wherein:

(a) the body of the at least one device has an open slot between the post and the face; and (b) the post of the at least one device has two opposite sides angled inwardly as they extend in a direction toward the through hole.

16. The cellular confinement system of claim 11 wherein:

(a) the at least one device transfers load exerted by an expanded first unitary section of cells to the at least one flexible tendon.

17. The cellular confinement system of claim 11 further comprising:

(a) a second unitary section of cells made from elongated plastic strips bonded together in spaced apart areas; the strips forming walls of the cells; at least some of the cells walls defining open slots;

(i) at least one open slot of the first unitary section of cells being aligned with at least one open slot of the second unitary section of cells to result in a cell overlap region; the cell overlap region having opposite first and second sides; and (b) at least a second device fastening the first unitary section of cells and the second unitary section of cells together; the second device having an insertion member located on the first side of the cell overlap region and a body located on the second side of the cell overlap region.

18. A method of transferring load from an expanded cellular confinement structure for retaining material to a flexible tendon; the method comprising:

(a) providing an expanded cell confinement structure having a plurality of cells formed by cell walls, the cell walls having first and second opposite sides and at least one open slot;

(b) inserting an insertion member of a device from the second side of the cell wall through the open slot to provide:

(i) the insertion member on the first side of the cell wall;

(ii) a body of the device on the second side of the cell wall; and (iii) a shank between the insertion member and the body extending through the open slot;

(c) inserting a tendon through a through-hole with a closed periphery in the body of the device, and (d) wrapping the tendon around a post of the body.

19. The method of claim 18 wherein:

(a) the step of inserting a tendon includes inserting a loop of the tendon through the through-hole in the body of the device, and wrapping the loop of the tendon around the post.

20. The method of claim 19 wherein:

(a) before wrapping the loop of the tendon around the post, twisting the loop at least once and then wrapping the twisted loop around the post.

21. The method of claim 20 wherein:

(a) wrapping the loop of the tendon around the post includes orienting a portion of the tendon in an open slot between the post and a face of the body.

22. The method of claim 19 wherein:

(a) after wrapping the loop of the tendon around the post, twisting the loop at least once and then wrapping the twisted loop around the post.

23. The method of claim 18 wherein the step of wrapping the tendon around a post of the body includes wrapping the tendon around a post having two opposite sides angled inwardly as they extend in a direction toward the through hole.

24. A kit comprising:

(a) a first unitary section of cells made from elongated plastic strips bonded together in spaced apart areas; the strips forming walls of the cells; at least some of the cell walls defining open slots;

(b) at least one device including:

an insertion member;

(ii) an integral shank extending from the insertion member; and (iii) an integral body extending from the shank at an end of the shank remote from the insertion member; the body including a post with a tendon-receiving holding surface and a through hole sized with a closed periphery to receive a tendon;

wherein the device can be oriented in at least one of the open slots such that the insertion member is located on a first side of the cell wall; the shank extends through the slot; and the body is located the second side of the cell wall; and (c) at least one tendon to secure the device and the first section of cells by looping through the through-hole in the body and wrapping around the tendon-receiving holding surface of the post.

25. The kit of claim 24 wherein the post of the device has two opposite sides angled inwardly as they extend in a direction toward the through hole.

26. The kit of claim 24 wherein the through hole in the body of the device is circular and has a diameter 50-80% of the length of the insertion member.

27. The kit of claim 24 wherein the through hole in the body of the device is circular and has a diameter 110-150% of the length of across a narrowest length of the post.

28. A device for use with at least one expanded cellular confinement structure; the device comprising:

(a) an insertion member having first and second opposite insertion ends;

(b) an integral shank extending from the insertion member and being spaced from each of the first and second insertion ends; and (c) an integral body extending from the shank at an end of the shank remote from the insertion member; the body including:

(i) a face opposing the insertion member;

(ii) a post with a tendon-receiving holding surface; and (iii) a through hole sized to receive a tendon;

wherein the post has two opposite sides angled inwardly as they extend in a direction toward the through hole.

29. The device of claim 28 wherein the two opposite sides of the post are angled 15-35° relative to the face.

30. The device of claim 28 wherein the shank is perpendicular relative to the insertion member and the face.

31. The device of claim 28 wherein the body has an open slot between the post and the face.

32. The device of claim 28 wherein the face has a thickness greater than a thickness of the insertion member.

33. A device for use with at least one expanded cellular confinement structure; the device comprising:

(a) an insertion member having first and second opposite insertion ends and having a length defined between the first and second insertion ends;

(b) an integral shank extending from the insertion member and being spaced from each of the first and second insertion ends; and (c) an integral body extending from the shank at an end of the shank remote from the insertion member; the body including:

(i) a face opposing the insertion member;

(ii) a post with a tendon-receiving holding surface; and (iii) a circular through hole sized to receive a tendon; the through hole having a diameter 50-80% of the length of the insertion member.

34. The device of claim 33 wherein the insertion member has a length defined between the first and second insertion ends; and (b) the body is spaced from the insertion member a distance 5-30% of the length of the insertion member.

35. The device of claim 33 wherein:

(a) the insertion member has a length defined between the first and second insertion ends; and (b) the face has a length longer than the length of the insertion member.

36. The device of claim 33 wherein the shank is perpendicular relative to the insertion member and the face.

37. A device for use with at least one expanded cellular confinement structure; the device comprising:

(a) an insertion member having first and second opposite insertion ends;

(b) an integral shank extending from the insertion member and being spaced from each of the first and second insertion ends; and (c) an integral body extending from the shank at an end of the shank remote from the insertion member; the body including:

(i) a face opposing the insertion member;

(ii) a post with a tendon-receiving holding surface; and (iii) a circular through hole sized to receive a tendon; the through hole having a diameter 110-150% of the length of across a narrowest length of the post.

38. The device of claim 37 wherein the post has two opposite sides angled inwardly as they extend in a direction toward the through hole.

39. The device of claim 37 wherein the body has an open slot between the post and the face.

40. The device of claim 37 wherein the face has a thickness greater than a thickness of the insertion member.

41. A cellular confinement system comprising:

(a) at least a first unitary section of cells made from elongated plastic strips bonded together in spaced apart areas; the strips forming walls of the cells; at least some of the cell walls defining open slots;

(b) at least one device oriented in a first one of the slots; the device including:

(i) an insertion member having first and second opposite insertion ends;

(A) the insertion member being located on a first side of the cell wall within the first one of the slots;

(ii) an integral shank extending from the insertion member and being spaced from each of the first and second insertion ends;

(iii) an integral body extending from the shank at an end of the shank remote from the insertion member;

(A) the body being located on a second side of the cell wall within the first one of the slots;

(B) the body including a face bearing against a portion of the second side of the cell wall adjacent to the first one of the slots; and (C) the body including a post and a through-hole, the post having two opposite sides angled inwardly as they extend in a direction toward the through hole;

(D) the body having an open slot between the post and the face; and (c) at least one flexible tendon extending through at least the first one of the slots;

(i) the at least one flexible tendon extending through the through-hole in the body of the device, and being wrapped around the post of the body.

42. The cellular confinement system of claim 41 wherein the tendon has a first tendon section extending through the through-hole in a first direction, a second tendon section wrapped around the post, and a third tendon section extending through the through-hole in a second direction opposite of the first direction.

43. The cellular confinement system of claim 41 wherein the at least one device transfers load exerted by an expanded first unitary section of cells to the at least one flexible tendon.

44. The cellular confinement system of claim 41 wherein the through hole in the body of the at least one the device is circular and has a diameter 50-80% of the length of the insertion member.

* * * * *